United States Patent [19]

Dangler

[11] Patent Number: 4,571,767

[45] Date of Patent: Feb. 25, 1986

[54] GOLF SHOE CLEAT CLEANER

[76] Inventor: Charles C. Dangler, 14620 Pebblestone Dr., Silver Spring, Md. 20904

[21] Appl. No.: 614,023

[22] Filed: May 25, 1984

[51] Int. Cl.[4] ..... A46B 15/00

[52] U.S. Cl. ..... 15/161; 15/112; 15/237; 273/162 R

[58] Field of Search ..... 15/112, 113, 160, 161, 15/237, 176; 273/77 R, 77 A, 162 R, 163 R

[56] References Cited

U.S. PATENT DOCUMENTS

| | | | |
|---|---|---|---|
| 622,024 | 3/1899 | Shaw | 15/112 |
| 1,331,499 | 2/1920 | Hartford | 273/163 R |
| 2,912,707 | 11/1959 | Fulton | 15/237 X |
| 3,271,806 | 9/1966 | Helmken | 15/176 |
| 3,451,092 | 6/1969 | Szopo | 15/161 X |

FOREIGN PATENT DOCUMENTS

| | | | |
|---|---|---|---|
| 23704 | of 1912 | United Kingdom | 15/112 |
| 300018 | 11/1928 | United Kingdom | 15/112 |
| 430844 | 6/1935 | United Kingdom | 273/163 R |
| 523744 | 7/1940 | United Kingdom | 15/112 |
| 817281 | 7/1959 | United Kingdom | 15/161 |

*Primary Examiner*—Peter Feldman

*Attorney, Agent, or Firm*—Howard W. Califano

[57] ABSTRACT

An apparatus is disclosed for cleaning grass and dirt from golf shoes. The invented apparatus may be carried in a golf bag and can be easily used while the golfer is positioned in an upright standing position. The invented apparatus generally includes: a rigid block or base which has a brush means mounted on the upper surface of the block; a tubular shaft, similar to a conventional golf club shaft is fixedly attached to the block or base; and, at least one cleat, mounted on the bottom surface of the block or base and adapted to be inserted into the ground.

13 Claims, 6 Drawing Figures

GOLF SHOE CLEAT CLEANER

BACKGROUND OF THE INVENTION

1. Field of the Invention

The invention relates to an apparatus for cleaning grass and dirt from golf shoes; the invented apparatus may be carried in a golf bag and can be easily used while the golfer is positioned in an upright standing position.

2. Description of the Prior Art

A golfer generally wears a pair of golf shoes which have a plurality of cleats on both the sole and heel of each shoe. The cleats dig into the playing surface and enable the golfer to have a sure footing while making a golf shot. During such operation, dirt tends to build up on the exposed portions of the heels and sole of golf shoes. The golf shoes become impacted between the cleats, which substantially interferes with the effective use of the golf shoes. It therefore becomes necessary to remove such dirt a number of times during a single round of golf.

Different types of cleat cleaners have been devised to remove such impacted dirt and debris. U.S. Pat. Nos. 2,980,936 and 3,270,360, issued to Q. L. Snow et al and R. E. Harris, Jr., respectively, describe hand held tools which are used to clean dirt from golf shoe cleats. To operate these prior art tools the golfer must either find a bench and be in a seated position or must balance on one leg while the other leg is raised to a position exposing the sole and heel to the cleaning tool. Alternatively, U.S. Pat. No. 3,028,617 issued to J. L. Racina describes a golf shoe cleaner which is attached to a mobile golf club bag carrier. The Racina device has advantages over the devices described in the above cited patents; but, the Racina device is not a hand held tool and to operate must be attached to a mobile bag carrier. The Racina device would be worthless to a golfer who did not choose to pull a mobile bag carrier. Due to the inconvenience of using the prior art golf shoe cleaners, the average golfer seldom takes the time to clean his cleats. Thus, in many cases the golfer obtains less than the desired amount of hold on the grassy surfaces.

SUMMARY OF THE INVENTION

The present inventor recognized the inadequacy of the prior art golf shoe cleaners. The current invention overcomes the inadequacies in the prior art by providing a hand held golf cleaner which can be easily used by the golfer while positioned in an upright standing position. The invented apparatus has a conventional golf club handle and shaft and can be easily carried in a golf bag with the clubs. The invented apparatus is operable by the golfer standing in an upright position. The golfer simply removes the golf shoe cleaner from the golf bag, and while resting the base of the golf shoe cleaner on the ground and while holding the handle of the cleaner, runs the cleats over the scrubber brush. In this manner, either golf shoe can be cleaned without the golfer having to find a seat or having to balance in an abnormal position.

The invented apparatus generally includes: a rigid block or base which has a brush means mounted on the upper surface of the block; a tubular shaft, similar to a conventional golf club shaft is fixedly attached to the block or base; and, at least one cleat, mounted on the bottom surface of the block or base and adapted to be inserted into the ground. In operation, the cleaner's cleats are inserted into the ground to hold the golf shoe cleaner stationary while a golf shoe is being scrubbed across the brush. The golfer, while standing in an upright position and holding onto the upper end or handle of the long tubular shaft scrubs first one and then the other shoe across the brush until the golf shoe is clean.

It is therefore, the first novel feature of this invention to provide a golf shoe cleaner which is a portable hand tool and which is operable by a golfer while standing in an upright position.

It is a second novel feature of this invention to provide a golf shoe cleaner with a cleating means so that it can be securely positioned into the ground during the scrubbing operation.

It is a third novel feature of this invention to have a long shaft which enables the golfer to place the brush of the cleaner in an operable position while the golfer is standing in an upright position.

It is a fourth novel feature of this invention to have a handle and shaft similar in length to a conventional golf club shaft, which tends to support and stabilize the golfer during the scrubbing operation.

DESCRIPTION OF THE PREFERRED EMBODIMENTS

Figure 1:
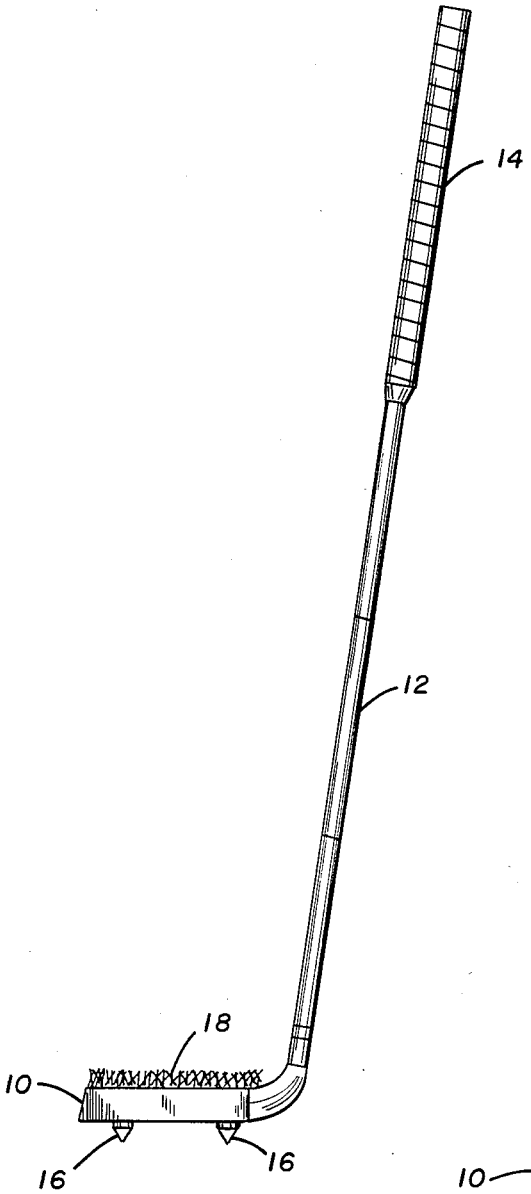
FIG. 1 is a side view of the golf shoe cleat cleaner as taught by the present invention.
Figure 2:
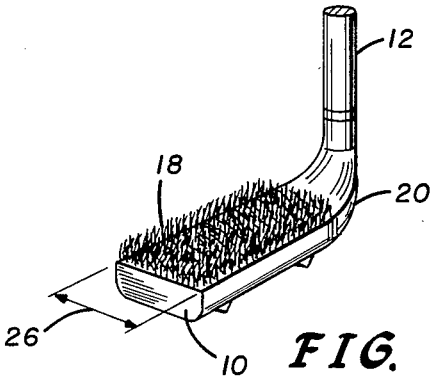
FIG. 2 is a perspective view of the block or base of the invented golf shoe cleaner.

The golf shoe cleaner as taught by the present invention is generally shown in FIG. 1. The cleaning apparatus generally comprises: a rigid block 10 generally rectangular in shape; a tubular shaft 12 which contains a handlegrip 14 is fixedly attached to one end of the rigid block 10 and is of a shape and length typical of conventional golf club design (generally ranging in length from 36 to 45 inches); a cleating means 16 mounted on the lower surface of rigid block 10 and adapted to be inserted into the ground; and, a brush means 18 mounted on the upper surface of rigid block 10. As shown in the drawing, the cleating means are fixed directly to the bottom surface of the rigid block and within the horizontal extent of the brush means taken along a line from left to right toward the shaft end of the block. As shown in FIG. 2, the brush means contains a plurality of upstanding bristles which substantially cover the upper surface of rigid block 10. The brush bristles may be made from nylon, wire or other suitable materials typically used in the design of golf shoe cleaning apparatus. As shown in FIG. 2, the rigid block 10 may have a tapered portion 20 where it connects to tubular shaft 12.

Figure 3:
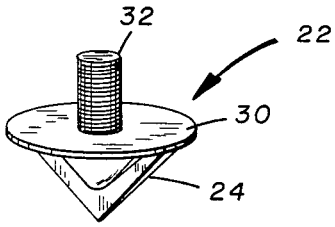
FIG. 3 is a perspective view of a cleat which can be mounted on the lower surface of the block or base and which is adapted for insertion into the ground.

The cleating means 16 generally contains two or more individual cleats 22 which are fixedly mounted on the bottom surface of rigid block 10. The individual cleats 22, may be of typical design having a conical spike portion, or they may be specially fabricated as shown in FIG. 3. The cleats 22 shown in FIG. 3 contain a thin triangular member 24 which is mounted on the bottom surface of the rigid block with the face of the triangular member 24 positioned perpendicular to the direction a golf shoe is scrubbed across the brush means 18. The orientation of the triangular members are best shown in FIGS. 1 and 2, with the arrow 26 in FIG. 2 indicating the general direction a golf shoe is scraped across the brush means 18. When the triangular members so orientated, are inserted into the ground or turf, they provide a maximum counter force against the scrubbing action of the shoe and tend to hold the golf shoe cleaner in place.

Figure 4:
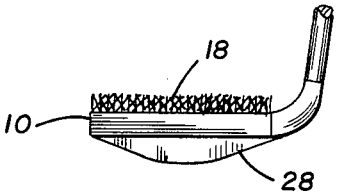
FIG. 4 is a side view of an alternative embodiment of the cleating means for the golf shoe cleaner as taught by the present invention.

FIG. 4 shows on alternative embodiment of the cleating means. A long, thin angular member 28 is fixedly mounted on the bottom surface of rigid block 10. The base of the angular member 28 extends essentially across a substantial position of the length of rigid block 10 and is orientated so that the face of the angular member is positioned perpendicular to the direction a shoe is scraped across the brush means 18. When the angular member 28 is inserted into the turf it provides a means for securing the rigid block 10 in position as the shoe is scraped across the brush.

Figure 5:
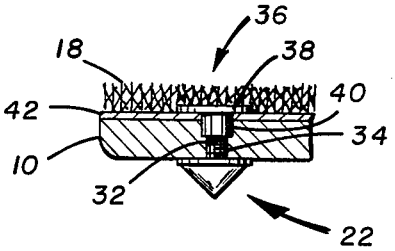
FIG. 5 is a cross-sectioned view of the present invention showing how the cleating means and brush means are attached to the base or block.

Referring again to FIG. 3, the thin triangular member 24 may be fixedly mounted onto a base portion 30. Base portion 30 may be welded onto the rigid block or contain a threaded shaft 32. The threaded shaft 32 may screw directly into the rigid block 10. Alternatively, as shown in FIG. 5, the threaded shaft 32, may pass through a hole 34 in the rigid block and mate with a connecting means 36. The connecting means 36 contains a flat washer-like flange 38 which connects to an elongated nut 40. The flange 38 rests against the upper surface of the brush substrate 42 in a small area not containing bristles. The elongated nut 40 of the connecting means extends through a hole in the brush substrate and is inserted into hole 40. The threaded shaft 32 of cleat 22 is screwed into the elongated nut portion 40 of connecting means 36, thereby securing the brush means 18 and the cleats 22 to rigid block 10. The invention suggests the use of two or more such cleats to secure the brush means 18 to the rigid block.

Figure 6:
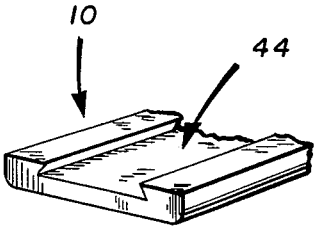
FIG. 6 is a partial perspective view showing a recess formed in the upper surface of the block or base into which the brush means can be inserted.

The brush means 18 may be connected to the rigid block 10 as shown in FIG. 5, and as described above. Alternatively, the brush means 18 may be glued or epoxied directly onto the rigid block 10. In either embodiment, the edge of the brush means may become dislodged during repeated use. FIG. 6 shows an alternative embodiment having a recess 44 formed in the upper surface of rigid block 10. The brush means 18 comprising a brush substrate 42 having a plurality of bristles fits into the recess and is fixedly mounted onto the rigid block 10 by the above described techniques.

In operation, the handle 14 of the golf club cleaner is held and the rigid block 10 is placed in a resting position on the ground with the cleat means 16 penetrating into the ground or turf. The golfer, positioned in an upright standing position, can scrub either shoe across the brush means 18 and dislodge mud, grass and dirt which has built up on the golf shoes. The cleat means 16 tends to keep the golf club cleaner stationary during such use.

Obviously, many modifications and variations of the present invention are possible in light of the above teachings. It is therefore to be understood that within the scope of the appended claims, the invention may be practiced otherwise than as specifically described.

What is claimed is:

1. A golf shoe cleaner, comprising:

a rigid block;

a brush means mounted on the upper surface of said rigid block for cleaning the sole and cleats of a golf shoe;

a cleating means mounted on the bottom surface of said rigid block and adapted to be inserted in the ground for holding said rigid block substantially stationary when a golf shoe is scrubbed across said brush means;

and, an upwardly extending tubular shaft, fixedly connected to one end of said block, having a length comparable to a conventional golf club, and adapted to allow a standing golfer to hold on to the upper end of said tubular shaft while said cleating means is inserted into the ground and to scrub a golf shoe worn by the golfer across said brush means, said cleating means mounted within the horizontal extent of the brush means taken in the direction along a line toward the fixedly connected shaft end of the block, wherein said cleating means comprises at least one flat member securely affixed directly to said bottom surface of said rigid block, a face of said at least one flat member positioned parallel to the plane said tubular shaft makes with said horizontal extent of said brush means wherein said flat member is positioned perpendicular to the direction a shoe is scrubbed across said brush means.

2. A golf shoe cleaner, comprising:

a rigid block;

a brush means mounted on the upper surface of said rigid block for cleaning the sole and cleats of a golf shoe;

a cleating means mounted on the bottom surface of said rigid block and adapted to be inserted in the ground for holding said rigid lock substantially stationary when a golf shoe is scrubbed across said brush means;

and, an upwardly extending tubular shaft, fixedly connected to one end of said block, having a length comparable to a conventional golf club, and adapted to allow a standing golfer to hold on to the upper end of said tubular shaft while said cleating means is inserted into the ground and to scrub a golf shoe worn by the golfer across the said brush means, said cleating means mounted within the horizontal extent of the brush means taken in the direction along a line toward the fixedly connected shaft end of the block, wherein said cleating means comprises at least two cleats each having a base portion and a thin triangular spike portion, said base portion mounted on the bottom surface of said block, and wherein a face of said thin triangular spike portion is positioned paralled to the plane said tubular shaft makes with said horizontal extent of said brush means wherein said face is positioned perpendicular to the direction a shoe is scrubbed across said brush means.

3. The apparatus of claims 1 or 2, wherein said tubular shaft is a conventionl golf club shaft, the upper portion of said golf club shaft having a conventional golf club handlegrip.

4. The apparatus of claim 1 or 2 wherein each of said cleats is welded onto said block.

5. The apparatus of claim 1 or 2 wherein each of said cleats is molded as part of said block.

6. The apparatus of claim 1 or 2 wherein a threaded screw is fixedly secured to the base of each of said cleats and each cleat is adapted to screw into a threaded hole in said block.

7. The apparatus of claim 3, wherein said cleating means includes a long thin angular member mounted on the bottom surface of said block, the base of said angular member extending across a substantial portion of the length of said block.

8. The apparatus of claim 1, wherein said brush means is permanently mounted on the upper surface of said block.

9. The apparatus of claim 8, wherein said brush means is epoxied to said block.

10. The apparatus of claim 1, wherein said brush means is removable.

11. The apparatus of claim 10, wherein at least one connecting screw, mating with a threaded hole in said block, mounts said brush means onto said block.

12. The apparatus of claim 11, wherein said brush means fits into a recess formed in the upper surface of said block.

13. The apparatus of claim 1 or 2 wherein a plurality of holes extends through said block running from said upper surface to said lower surface, wherein a base portion of each cleat is fixedly connected to a threaded screw adapted to extend through one of said holes and to screw into one of a plurality of connecting means, each connecting means positioned above said brush means for securing said brush area to the upper surface of said block.

* * * * *